United States Patent [19]

Corsmeier et al.

[11] Patent Number: 5,049,033

[45] Date of Patent: Sep. 17, 1991

[54] BLADE TIP CLEARANCE CONTROL APPARATUS USING CAM-ACTUATED SHROUD SEGMENT POSITIONING MECHANISM

[75] Inventors: Robert J. Corsmeier, Cincinnati; Ambrose A. Hauser, Wyoming, both of Ohio

[73] Assignee: General Electric Company, Cincinnati, Ohio

[21] Appl. No.: 482,139

[22] Filed: Feb. 20, 1990

[51] Int. Cl.[5] ..... F01D 5/20

[52] U.S. Cl. ..... 415/173.2; 415/127; 74/107

[58] Field of Search ..... 415/126, 127, 173.1, 415/173.2, 173.3, 174.1, 174.2, 134, 136, 139; 74/99 A, 107

[56] References Cited

U.S. PATENT DOCUMENTS

| | | | |
|---|---|---|---|
| 3,039,737 | 6/1962 | Kolthoff, Jr. | 253/39.1 |
| 3,062,497 | 11/1962 | Howes et al. | 253/39 |
| 3,085,398 | 4/1963 | Ingleson | 60/39.32 |
| 3,520,635 | 7/1970 | Killmann et al. | 415/138 |
| 3,623,736 | 11/1971 | Petrie et al. | 277/27 |
| 3,966,354 | 12/1974 | Patterson | 415/116 |
| 4,005,946 | 6/1975 | Brown et al. | 415/136 |
| 4,050,843 | 9/1977 | Needham et al. | 415/116 |
| 4,230,436 | 10/1980 | Davison | 415/1 |
| 4,264,274 | 4/1981 | Benedict | 415/199.5 |
| 4,330,234 | 5/1982 | Colley | 415/171 |
| 4,332,523 | 6/1982 | Smith | 415/126 |
| 4,343,592 | 8/1982 | May | 415/173.2 |
| 4,384,819 | 5/1983 | Baker | 415/14 |
| 4,419,044 | 12/1983 | Barry et al. | 415/117 |
| 4,632,635 | 12/1986 | Thoman et al. | 415/14 |
| 4,657,479 | 4/1987 | Brown et al. | 415/138 |
| 4,683,716 | 8/1987 | Wright et al. | 60/226.1 |
| 4,714,404 | 12/1987 | Lardellier | 415/127 |
| 4,773,817 | 9/1988 | Stangalini | 415/48 |
| 4,810,165 | 3/1989 | Greune et al. | 415/134 |

FOREIGN PATENT DOCUMENTS

| | | | |
|---|---|---|---|
| 0153904 | 9/1982 | Japan | 415/174.1 |
| 2068470 | 8/1981 | United Kingdom . | |
| 2199664 | 7/1988 | United Kingdom . | |

*Primary Examiner*—John T. Kwon
*Assistant Examiner*—Christopher M. Verdier
*Attorney, Agent, or Firm*—Jerome C. Squillaro

[57] ABSTRACT

A clearance control apparatus has a positioning mechanism for controlling clearance between rotor blade tips and a shroud segment of a gas turbine engine casing, and a rotatable lever for actuating the mechanism. The positioning mechanism is supported by a casing boss, coupled to the shroud segment, and actuatable for moving the shroud segment toward and away from the rotor blade tips to reach a position at which a desired clearance is established. The mechanism includes a shaft and a pair of cam elements. The shaft is mounted by the boss for radial movement toward and away from the rotor axis and coupled at its inner end to the shroud segment. An outer cam element is attached to the outer end of the shaft and spaced outwardly from the boss. An inner cam element is attached to an end of the lever mounted to the boss for rotational movement about a longitudinal axis of the shaft. The inner cam element is located between an outer end of the boss and the outer cam element and engaged with the outer cam element such that rotation of the inner cam element with rotation of the lever produces radial movement of the outer cam element and of the shaft and shroud segment therewith toward and away from the rotor blade tips.

21 Claims, 5 Drawing Sheets

BLADE TIP CLEARANCE CONTROL APPARATUS USING CAM-ACTUATED SHROUD SEGMENT POSITIONING MECHANISM

RIGHTS OF THE GOVERNMENT

The United States Government has rights in this invention pursuant to Contract No. F33615-87-C-2764 awarded by the Department of the Air Force.

CROSS-REFERENCE TO RELATED APPLICATIONS

Reference is hereby made to the following copending U.S. patent applications dealing with related subject matter and assigned to the assignee of the present invention:

1. "Blade Tip Clearance Control Apparatus For A Gas Turbine Engine" by John J. Ciokajlo, assigned U.S. Ser. No. 405,369 and filed Sept. 8, 1989.
2. "Mechanical Blade Tip Clearance Control Apparatus For A Gas Turbine Engine" by John J. Ciokajlo et al, assigned U.S. Ser. No. 404,923 and filed Sept. 8, 1989.
3. "Blade Tip Clearance Control Apparatus Using Bellcrank Mechanism" by Robert J. Corsmeir et al, assigned U.S. Ser. No. 440,663 and filed Nov. 22, 1989.
4. "Blade Tip Clearance Control Apparatus Using Shroud Segment Position Modulation" by Robert J. Corsmeir et al, assigned U.S. Ser. No. 480,198 and filed Feb. 12, 1990.

BACKGROUND OF THE INVENTION

1. Field of the Invention

The present invention relates generally to gas turbine engines and, more particularly, to an apparatus for controlling clearance between adjacent rotating and non-rotating components of a gas turbine engine.

2. Description of the Prior Art

The efficiency of a gas turbine engine is dependent upon many factors, one of which is the radial clearance between adjacent rotating and non-rotating components, such as, the rotor blade tips and the casing shroud surrounding the outer tips of the rotor blades. If the clearance is too great, an unacceptable degree of gas leakage will occur with a resultant loss in efficiency. If the clearance is too little, there is a risk that under certain conditions contact will occur between the components.

The potential for contact occurring is particularly acute when the engine rotational speed is changing, either increasing or decreasing, since temperature differentials across the engine frequently result in the rotating and non-rotating components radially expanding and contracting at differ rates. For instance, upon engine accelerations, thermal growth of the rotor typically lags behind that of the casing. During steady-state operation, the growth of the casing ordinarily matches more closely that of the rotor. Upon engine decelerations, the casing contracts more rapidly than the rotor.

Control mechanisms, usually mechanically or thermally actuated, have been proposed in the prior art to maintain blade tip clearance substantially constant. However, none are believed to represent the optimum design for controlling clearance. Consequently, a need still remains for an improved mechanism for clearance control that will permit maintenance of minimum rotor blade tip-shroud clearance throughout the operating range of the engine and thereby improve engine performance and reduce fuel consumption.

SUMMARY OF THE INVENTION

The present invention provides a blade tip clearance control apparatus which satisfies the aforementioned needs and achieves the foregoing objectives. Further, the blade tip clearance control apparatus employs a cam-actuated shroud segment positioning mechanism which achieves these objectives without a large increase in weight. The components of the positioning mechanism containing the cam surfaces are located outside the casing for easy maintenance. Further, the size of the cam surfaces can be made as large as needed for reducing wear and extending useful life. The components of the positioning mechanism are few in number, easy to manufacture and assemble, and arranged to provide a large mechanical advantage, for instance 150 to 1, making shroud segment in and out radial movement very insensitive to unison ring movement.

The clearance control apparatus of the present invention is provided in a gas turbine engine which includes a rotatable rotor having a central axis and a row of blades with tips and a stationary casing, with a shroud, disposed in concentric relation with the rotor. The clearance control apparatus, operable for controlling the clearance between the rotor blade tips and the casing shroud, comprises: (a) a shroud segment defining a circumferential portion of the casing shroud and being separate from and spaced radially inwardly of the casing; (b) at least one mounting structure on the stationary casing defining a passage between exterior and interior sides of the casing, the mounting structure being spaced radially outwardly from the shroud segment; (c) a shroud segment positioning mechanism supported by the stationary casing mounting structure, coupled to the shroud segment, and being actuatable for moving the shroud segment toward and away from the rotor to reach a selected position relative to the rotor at which a desired clearance is established between the shroud segment and rotor blade tips; and (d) an actuating member in the form of a lever arm being rotatable for actuating the positioning mechanism.

More particularly, the positioning mechanism includes a support member, and first and second cam elements. The support member is mounted through the passage defined by the casing mounting structure for radial movement relative to the mounting structure and toward and away from the central rotor axis. The support member has a longitudinal axis and opposite inner and outer ends with the shroud segment being coupled to the inner end of the support member at the interior side of the casing. The first cam element is stationarily attached to the outer end of the support member and located at the exterior side of the casing and spaced outwardly from the mounting structure. The second cam element is attached to an inner end of the lever arm being mounted to the mounting structure for rotational movement relative thereto and about the longitudinal axis of the support member upon rotation of the lever arm for actuating the positioning mechanism. The second cam element is located at the exterior side of the casing between the mounting structure and the first cam element and engaged with the first cam element such that rotation of the second cam element, upon actuation of the positioning mechanism by rotation of the lever arm, produces radial movement of the first cam element and radial movement therewith of the shaft and the shroud segment toward and away from the rotor to reach the selected position relative to the rotor. Also, the positioning mechanism includes means coupled to the inner shaft end and located at the interior side of the casing for pivotally supporting the shroud segment.

These and other features and advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
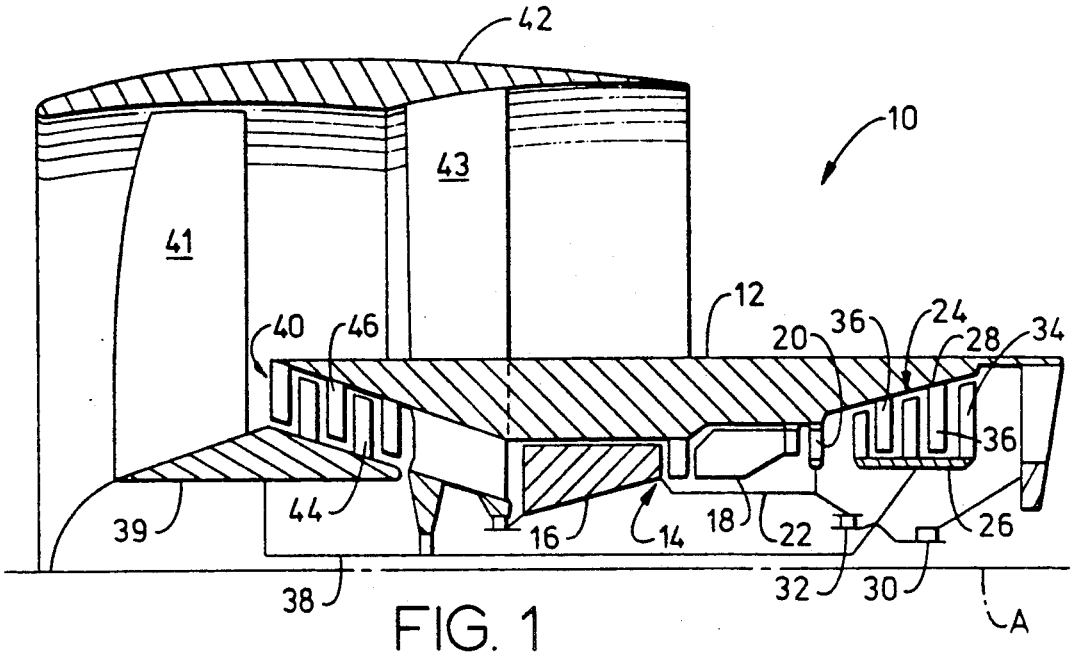
FIG. 1 is a schematic view of a gas turbine engine.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

In General

Referring now to the drawings, and particularly to FIG. 1, there is illustrated a gas turbine engine, generally designated 10, to which the present invention can be applied. The engine 10 has a longitudinal center line or axis A and an annular casing 12 disposed coaxially and concentrically about the axis A. The engine 10 includes a core gas generator engine 14 which is composed of a compressor 16, a combustor 18, and a high pressure turbine 20, either single or multiple stage, all arranged coaxially about the longitudinal axis or center line A of the engine 10 in a serial, axial flow relationship. An annular drive shaft 22 fixedly interconnects the compressor 16 and high pressure turbine 20.

The core engine 14 is effective for generating combustion gases. Pressurized air from the compressor 16 is mixed with fuel in the combustor 18 and ignited, thereby generating combustion gases. Some work is extracted from these gases by the high pressure turbine 20 which drives the compressor 16. The remainder of the combustion gases are discharged from the core engine 14 into a low pressure power turbine 24.

The low pressure turbine 24 includes an annular drum rotor 26 and a stator 28. The rotor 26 is rotatably mounted by suitable bearings 30 and includes a plurality of turbine blade rows 34 extending radially outwardly therefrom and axially spaced. The stator 28 is disposed radially outwardly of the rotor 26 and has a plurality of stator vane rows 36 fixedly attached to and extending radially inwardly from the stationary casing 12. The stator vane rows 36 are axially spaced so as to alternate with the turbine blade rows 34. The rotor 26 is fixedly attached to drive shaft 38 and interconnected to drive shaft 22 via differential bearings 32. The drive shaft 38, in turn, rotatably drives a forward booster rotor 39 which forms part of a booster compressor 40 and which also supports forward fan blade rows 41 that are housed within a nacelle 42 supported about the stationary casing 12 by a plurality of struts 43, only one of which is shown. The booster compressor 40 is comprised of a plurality of booster blade rows 44 fixedly attached to and extending radially outwardly from the booster rotor 39 for rotation therewith and a plurality of booster stator vane rows 46 fixedly attached to and extending radially inwardly from the stationary casing 12. Both the booster blade rows 44 and the stator vane rows 46 are axially spaced and so arranged to alternate with one another.

Clearance Control Apparatus of the Prior Art

Figure 2:
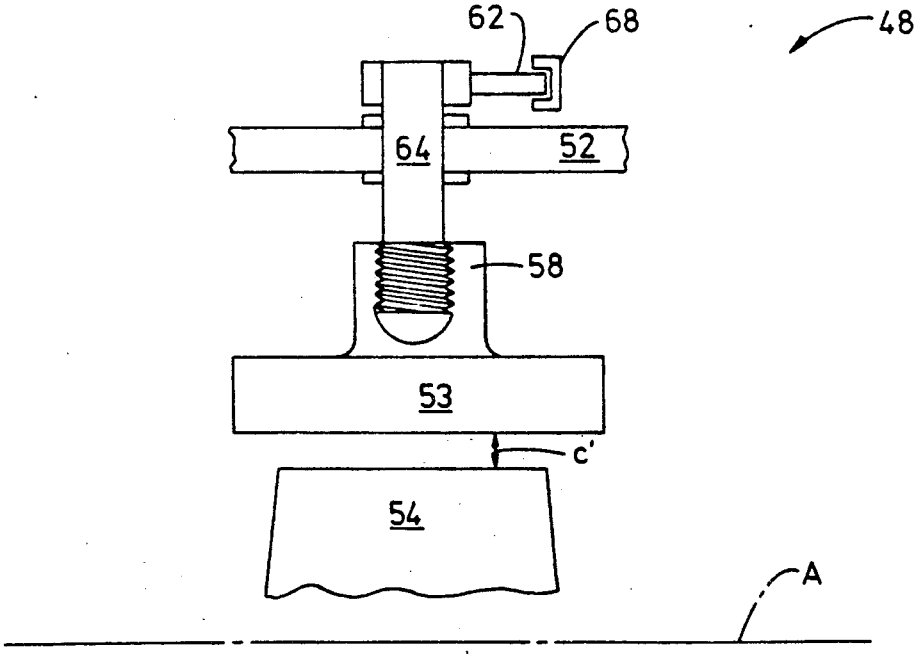
FIG. 2 (PRIOR ART)
FIG. 2 is a longitudinal axial sectional view of one prior art mechanical apparatus for controlling rotor blade tip and stator casing shroud clearance.
Figure 3:
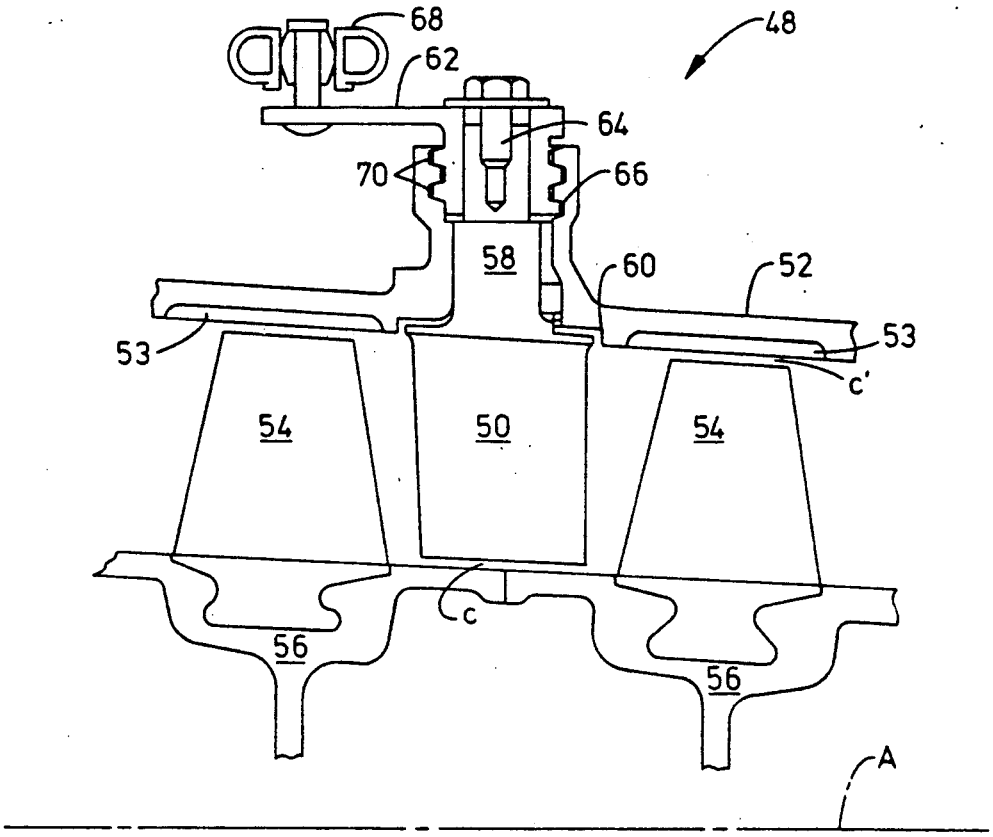
FIG. 3 (PRIOR ART)
FIG. 3 is a longitudinal axial sectional view of another prior art mechanical apparatus for controlling rotor and stator vane tip clearance.
Figure 4:
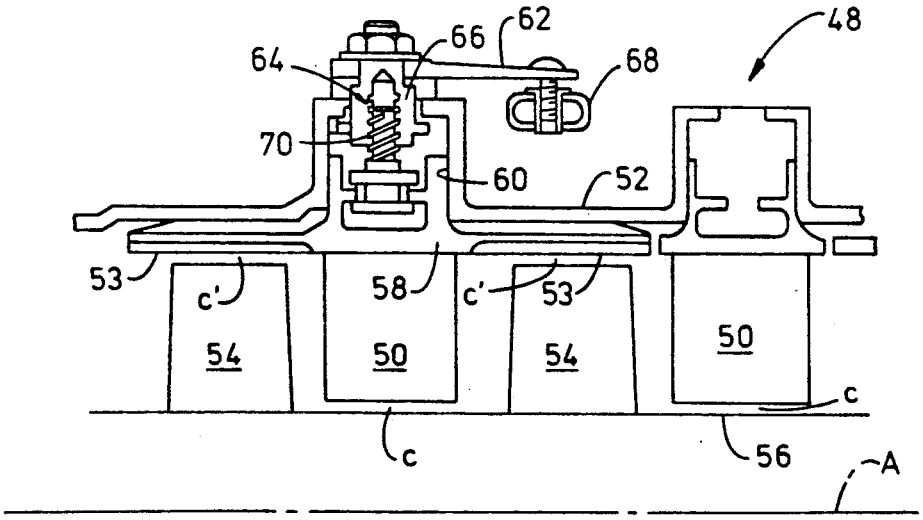
FIG. 4 (PRIOR ART)
FIG. 4 is a longitudinal axial sectional view of yet another prior art mechanical apparatus for controlling rotor blade tip and stator casing shroud clearance and rotor and stator vane tip clearance.

Referring now to FIGS. 2, 3 and 4, there is illustrated three variations of a prior art clearance control apparatus, generally designated 48 (disclosed on pages 8 and 15 of a publication entitled "Thermal Response Turbine Shroud Study" by E. J. Kawecki, dated July 1979, Technical Report AFAPL-TR-79-2087). The clearance control apparatus 48 is operable for changing the tip clearance gap C between the stator vanes 50, coupled on a stationary casing 52, and a rotatable rotor 56; and/or, the tip clearance gap C' between the rotatable rotor blades 54 and the casing shroud 53 of a gas turbine engine, such as the engine 10 just described.

In the FIG. 2 embodiment, the shroud segment 53 is separate from the casing 52 and is mounted on the end of screw 64 for radial movement relative to the casing 52 toward and away from the tip of the rotor blade 54 for adjustment of the clearance gap C' therebetween. In the FIGS. 3 and 4 embodiments, the stator vanes 50 are mounted on shanks 58 which, in turn, are disposed in openings 60 in the casing 52 for radial movement toward and away from the rotor 56. Each shank is coupled to a lever arm 62 by a screw 64 threaded into a fitting 66 attached to the casing 52. Also, a unison ring 68 upon circumferential movement rotates the screw 64 via the lever arm 62 in order to adjust the clearance gap. To reduce the effects of thermal expansion on the clearance control apparatus 48, each screw 64 has threads 70 of a square cross section. In each of these embodiments, the shroud segment 53 is attached to the stationary casing 52 with the shroud segment 53 being fixedly attached in the FIG. 3 embodiment and movably attached in the FIG. 4 embodiment.

It should be noted that in the FIG. 3 embodiment, the clearance control apparatus 48 operates to adjust the clearance gap C between the tip of the stator vane 50 and the rotor 56, but does not adjust the clearance gap C' between the tip of the rotor blade 54 and the shroud segment 53. However, in the FIG. 4 embodiment, operation of the clearance control apparatus 48 not only adjusts the clearance gap C between the tip of the stator vane 50 and the rotor 56, but also, simultaneously therewith, adjusts the clearance gap C' between the tip of the rotor blade 54 and the shroud segment 53.

Clearance Control Apparatus of Present Invention

Turning now to FIGS. 5-9, there is illustrated a first embodiment of a mechanical clearance control apparatus, generally designated 72, in accordance with the present invention. This apparatus 72 can advantageously be used with all compressor and turbine rotors of a gas turbine engine, such as the engine 10 illustrated in FIG. 1, where the rotors have smooth shrouded outer flowpaths and where rotor blade tip to shroud operating minimum clearances are required over the operating range of the engine. Also, the clearance control apparatus 72 is applicable to either aircraft or land based gas turbine engines.

The clearance control apparatus 72 is operable for controlling the clearance between a stationary casing 74 and outer tips 76A of a plurality of blades 76 (shown in FIGS. 5 and 8) of a rotor (not shown) which extend radially outwardly in alternating fashion between stator vanes (not shown) which, in turn, are stationarily attached to and extending radially inwardly from the casing 74. More particularly, a plurality of the clearance control apparatuses 72 (only one being shown in FIG. 5) are ganged to a circumferentially extending unison ring 78 to operate moving parts of the apparatuses 72 together to control the clearance the entire 360 degrees around the rotor blade tips 76A and the stationary casing 74.

Figures 5, 6, 7:
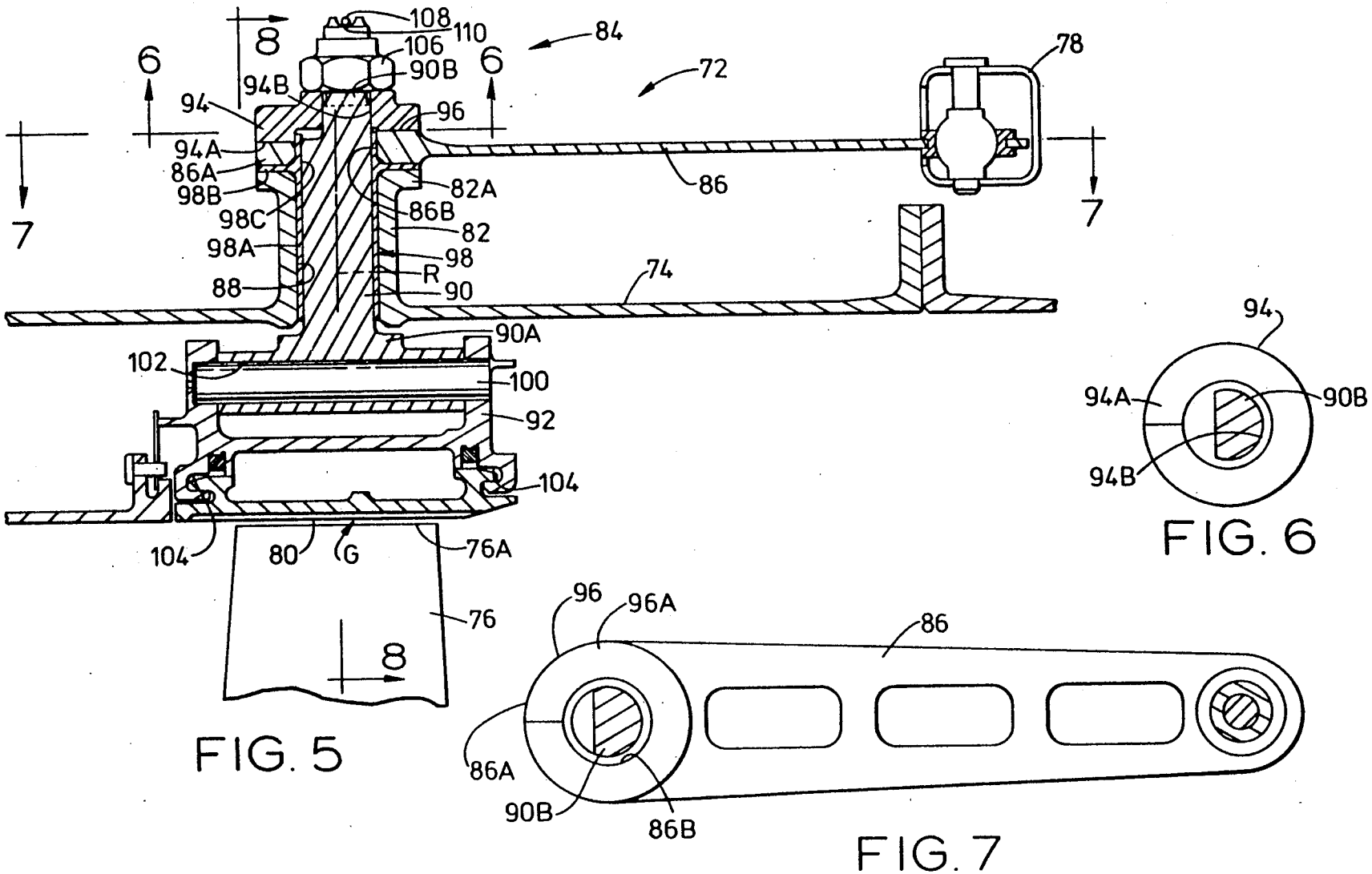
FIG. 5 is a longitudinal axial sectional view of one embodiment of a blade tip clearance control apparatus in accordance with the present invention.
FIG. 6 is an inner plan view of a cam washer of the apparatus as seen along line 6—6 of FIG. 5.
FIG. 7 is an outer view of an actuating arm and bearing bushing and a cross-sectional view of a holder shaft of the apparatus as seen along line 7—7 of FIG. 5.
Figure 8:
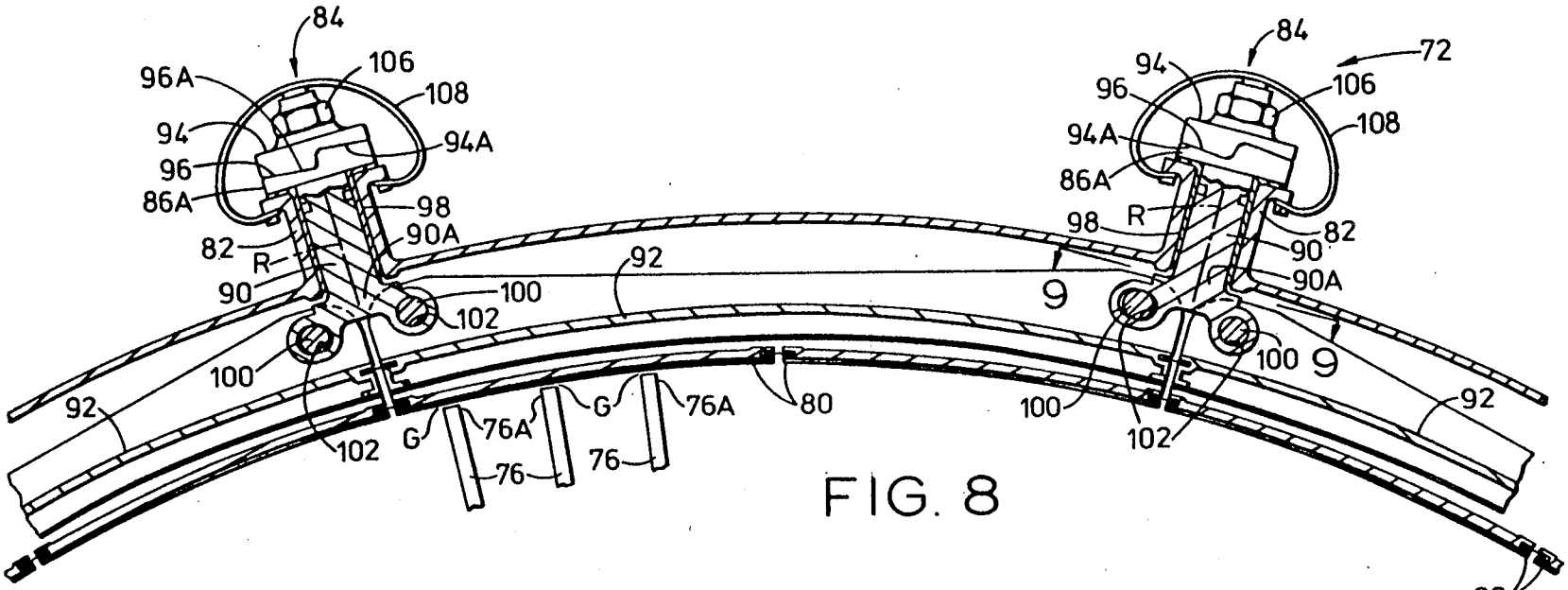
FIG. 8 is a transverse sectional view of the apparatus as taken along line 8—8 of FIG. 5.
Figure 9:
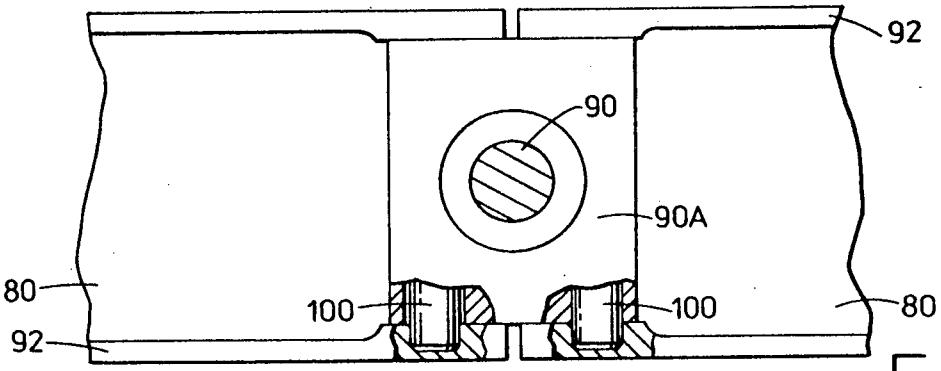
FIG. 9 is an outer plan view, partly in section, of the apparatus as seen along line 9—9 of FIG. 8.

Each clearance control apparatus 72 includes at least one, and preferably two or more, shroud segments 80 (as seen in FIG. 8), each having an elongated arcuate-shaped body. The shroud segments 80 define successive circumferential portions of a casing shroud and are separate from and spaced radially inwardly of the casing 74. In addition to the shroud segments 80, each clearance control apparatus 72 includes a pair of mounting structures in the form of cylindrical bosses 82 formed on the casing 74, a shroud segment positioning mechanism 84, and a pair of actuating members in the form of lever arms 86 for actuating the positioning mechanism 84. The mounting bosses 82 are integral with the casing 74, define respective passages 88 extending between the outer, or exterior, side and the inner, or interior, side of the casing 74, are spaced radially outwardly from the shroud segments 80, and project outwardly from the exterior side of the casing. The positioning mechanism 84 is supported by the stationary casing bosses 82 and coupled to the shroud segments 80. The lever arms 86 (only one of which is seen in FIG. 5) are rotated by the unison ring 78 to actuate the positioning mechanism 84 for moving the shroud segments 80 toward and away from the rotor blade tips 76A to reach a selected position relative thereto at which a desired clearance is established between the shroud segments 80 add rotor blade tips 76A.

More particularly, each positioning mechanism 84 includes a pair of circumferentially-spaced support shafts 90, a shroud hanger or holder 92, and pairs of outer cam elements 94 and inner cam elements 96. Each shaft 90 is mounted to one boss 82 and extends through its passage 88 for radial sliding movement relative thereto toward and away from the central axis A of the engine and the rotor thereof. The portion of the support shaft 90 extending through the passage of the boss 82 is in the form of an elongated solid bar of generally cylindrical cross-sectional shape and has a longitudinal axis R which extends in the radial direction.

Further, a pair of bearing members 98 are provided in the clearance control apparatus 72. The bearing members 98 are fitted internally to respective ones of the bosses 82 and extending through the passage 88 thereof. Each bearing member 98 includes a tubular body 98A defining an interior bearing surface slidably engaged by the shaft 90 and a circumferential flange 98B attached to and projecting outwardly from the exterior of the tubular body 98A between outer and inner opposite ends of the body. The flange 98B of the bearing member 98 is attached to the tubular body thereof substantially nearer to the outer end than to the inner end thereof. Thus, the flanges 98B seat upon an outer end 82A of the respective one boss 82 such that an outer end portion 98C of the body 98A projects from the boss 82 and flange 98B. The flange 98B and outer body end portion 98C are exposed at the exterior side of the casing 74 and define respective exterior bearing surfaces which engage and rotatably support an inner end 86A of a respective one of the actuating lever arms 86 of the apparatus 72.

The shroud holder 92 of the positioning mechanism 84 is located at the interior side of the casing 74 adjacent the shroud segments 80. The shroud holder 92 has an elongated arcuate-shaped body which extends between and is pivotally connected at its opposite ends to the inner ends 90A of the shafts 90 by pivot pins 100 which extend through transverse bores 102 formed through the shaft ends 90A. The shroud holder 92 has a pair of axially-spaced circumferentially-extending grooves 104 which face toward one another for slidably receiving and removably holding the shroud segments 80 at spaced longitudinal edge portions thereof and in spaced apart end-to-end tandem fashion, as best seen in FIGS. 5 and 8. The narrow space between the shroud segments 80 at their adjacent ends and the oblong cross-sectional configuration of one of the bores 102 in one of the inner shaft ends accommodates the change in the circumference of the shroud formed by the shroud segments 80 as they move radially toward and away from the rotor blade tips 76A. It will be noted in FIGS. 8 and 9 that each shaft 90 is shared by two adjacent shroud holders 92.

Each outer cam element 94 of the positioning mechanism 84 is in the form of an annular washer 94 having a helically-shaped camming surface 94A defined on an inner side of the washer. As best seen in FIG. 6, the washer 94 also has a D-shaped opening 94B for insertion on the outer end 90B of the shaft 90 which has a complementary D-shaped cross-section. These configurations of the washer opening 94B and shaft outer end 90B prevent relative rotation between the washer 94 and the shaft 90. The outer end 90B of the shaft 90 and the washer 94 are located at the exterior side of the casing 74 and spaced outwardly from the outer end 82A of the boss 82.

The inner end 86A of the lever arm 86 is disposed between the washer 94 and the flange 98B of the bearing member 98 which is seated on the outer end 82A of the boss 82. The lever arm inner end 86A contains a circular hole 86B (FIG. 7) through which extends the shaft 90 and outer end portion 98C of the bearing member 98 such that the lever arm 86 at its inner end 86A rotates about the longitudinal axis R of the shaft 90. The inner cam element 96 has a helically-shaped camming surface 96A defined on an outer side of the inner end 86A of the lever arm 86 which has a complementary configuration to that of the camming surface on the washer 94 for mating engagement therewith. Therefore, rotation of the inner cam elements 96 upon rotation of the lever arms 86 produces radial movement of the outer cam washers 94 and of the support shafts 90, shroud holder 92 and shroud segments 80 therewith toward and away from the rotor blade tips 76A.

Additionally the positioning mechanism 84 includes a pair of locking nuts 106. As seen in FIG. 5, each nut 106 is threadably attached to the externally threaded portion of the outer end of the shaft 90. The locking nut 106 retains the outer cam washer 94 removably attached on the outer ends 90B of the shaft 90. Also, a spring member 108 is provided in the positioning mechanism 84. One spring member 108 is attached to the outer end 82A of each boss 82 and overlies and engages a groove 110 defined on the distal end of the shaft 90 so as to bias the outer cam element 94 toward the inner cam element 96 to maintain engagement therebetween. When the engine 10 is in operation, the pressure of the cooling air keeps the shroud segments 80 pushed inwardly. The result of this also keeps the mating surfaces of the cam elements in tight contact. When the engine is not running, the surfaces may tend to open slightly. If this is undesirable, the spring members 108 may be used to keep the cam surfaces tight together.

In summary, the positioning mechanisms 84 of the apparatuses 72 are ganged to the unison ring 78 and operable for radially moving the shroud segments 80 toward and away from the rotor blade tips 76A to reach a selected position relative to the rotor (not shown) at which a desired clearance (gap G in FIGS. 5 and 8) is established between the shroud segments 80 and the rotor blade tips 76A. Further, the mechanisms 84 hold the shroud segments 80 at the selected positions to maintain the desired clearance between the shroud segments and the rotor blade tips upon termination of rotation of the unison ring 78. The spring members 108 continue to impose an inward biasing force on the shroud segments 80 via the shafts 90 regardless of the radial position of the latter in order to ensure mating engagement between the cam surfaces and to deter vibration and rattling of the components.

The above-described arrangement of the positioning mechanism 84 as seen in FIG. 5 permits a relationship between the length of the lever arm 86, radius of the unison ring 78 and radius of the cam surfaces which produces a large mechanical advantage relative to the amount of radial movement of the shaft 90 and shroud segment 80 produced by a given circumferential movement of the unison ring 78. For example, a ratio of 150 to 1 between the movement of the unison ring compared to the movement of the shroud segments can be produced, making the radial movement of the shroud segments relatively insensitive to the lever/unison ring movement.

In instances where it is desirable to decrease the radius of the unison ring 78, to decrease the length of the lever arm 86, and to decrease the height of the boss 82 in order to reduce the overall profile of the positioning mechanism 84 extending outwardly from the casing exterior, certain modifications can be made to compensate for these changes within the purview of the present invention as will be explained below.

Figure 10:
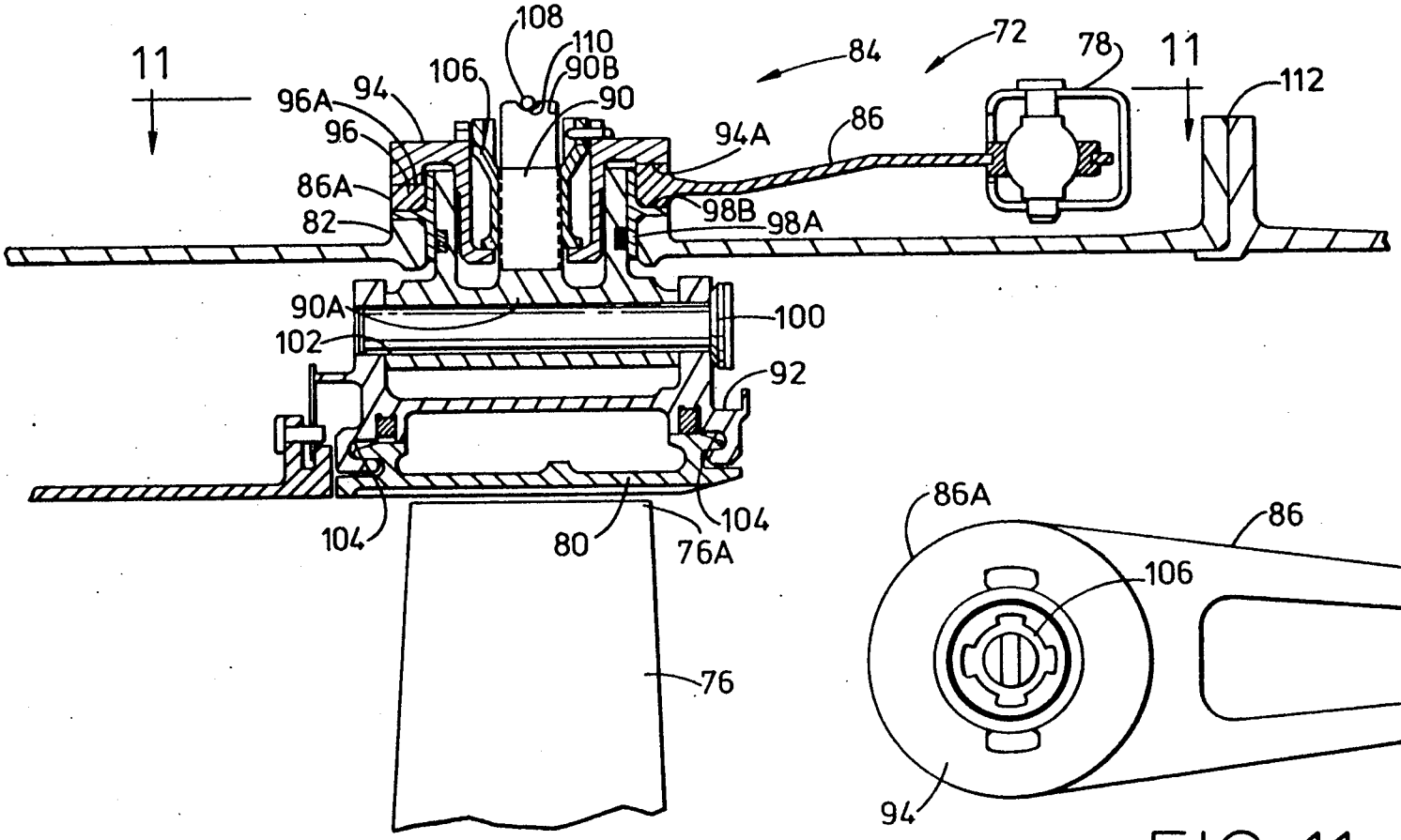
FIG. 10 is a view similar to FIG. 5 of another embodiment of the clearance control apparatus in accordance with the present invention.
Figure 11:
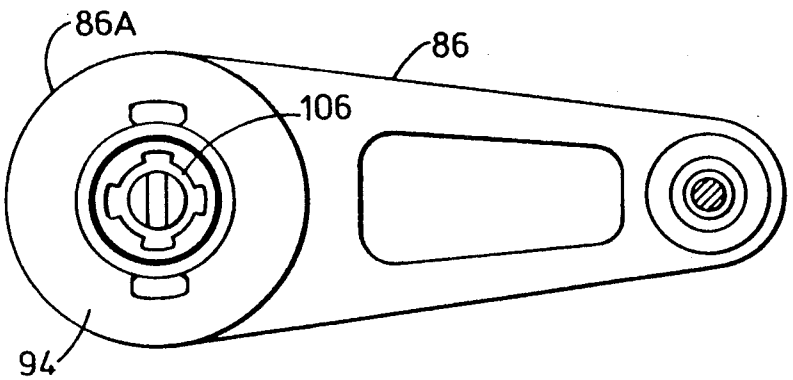
FIG. 11 is an outer plan view of an actuating arm, cam washer and attachment nut of the apparatus as seen along line 11—11 of FIG. 10.

Referring to FIGS. 10 and 11, there is illustrated a second embodiment, low boss design, of the positioning mechanism 84 which takes a slightly modified form compared to the first embodiment, a high boss design, discussed above and seen in FIGS. 5–9. Only the modifications provided by the second embodiment of the apparatus 72 will be described. In general, the casing boss 82 height has been substantially shortened, the unison ring 78 has been reduced in radius, and the lever arm 86 has been shortened so that the unison ring will not interfere with with the casing flanges 112. More specifically, the flange 98B of the bearing member 98 is now located substantially equidistant from the outer and inner ends of the tubular body 98A. The diameters of the outer and inner cam elements 94, 96 have been increased to increase the arc of travel of the inner cam element 96 and compensate for the shorter arc of rotation of the unison ring 78 and lever arm 96 due the decrease of the respective radius and length of the ring and arm in the second embodiment. Even though the lever arm 86 length has been shortened, the mechanical advantage ratio has been retained with these modifications. The configurations of the outer cam washer 94 and of the locking nut 106 have been modified to allow a lower overall profile of the positioning mechanism 84 in this low boss design.

A conventional rotor clearance sensor (not shown) can be used for sensing the actual rotor blade tip shroud clearance and sending a signal to a control device which, in turn, activates an actuator to rotate the unison ring 78 for changing the clearance in the manner described earlier. Since the clearance sensor and the components associated therewith form no part of the present invention, a detailed discussion of them is not necessary.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof.

We claim:

1. In a gas turbine engine including a rotatable rotor having a central axis an a row of blades with outer tips and a stationary casing with a shroud disposed in concentric relation with said rotor, an apparatus for controlling the clearance between said rotor blade tips and casing shroud, said apparatus comprising:

(a) a shroud segment defining a circumferential portion of said casing shroud and being separate from and spaced radially inwardly of said casing;

(b) at least one mounting structure on said stationary casing defining a passage between exterior and interior sides of said casing, said mounting structure being spaced radially outwardly from said shroud segment;

(c) a shroud segment positioning mechanism supported by said stationary casing mounting structure, coupled to said shroud segment, and being actuatable for moving said shroud segment toward and away from said rotor blade tips to reach a position relative thereto at which a desired clearance is established between said shroud segment and rotor blade tips; and (d) an actuating member being rotatable for actuating said positioning mechanism;

(e) said positioning mechanism including (i) a support member mounted through said passage defined by said mounting structure for radial movement relative to said mounting structure and toward and away from said rotor axis, said support member having a longitudinal axis and opposite inner and outer ends with said shroud segment being coupled to said inner end of said support member at said interior side of said casing, (ii) a first cam element attached to said outer end of said support member and located at said exterior side of said casing and spaced outwardly from said mounting structure, and (iii) a second cam element attached to an inner end of said actuating member being mounted to said mounting structure for rotational movement relative thereto and about said longitudinal axis of said support member upon rotation of said actuating member, said second cam element being located at said exterior side of said casing between said mounting structure and said first cam element and engaged with said first cam element such that rotation of said second cam element with rotation of said actuating member produces radial movement of said first cam element and said support member and said shroud segment therewith toward and away from said rotor blade tips.

2. The apparatus as recited in claim 1, wherein:

said mounting structure is a cylindrical boss formed on said casing, defining said passage and projecting from said exterior side of said casing; and said support member is a cylindrical shaft extending through said passage of said boss.

3. The apparatus as recited in claim 2, wherein said positioning mechanism also includes a shroud holder connected to said inner end of said support member and having axially-spaced circumferentially-extending grooves for slidably receiving and holding said shroud segment at spaced longitudinal edge portions thereof.

4. The apparatus as recited in claim 1, further comprising:

a bearing member fitted to said mounting structure and extending through said passage thereof, said bearing member including a tubular body defining an interior bearing surface slidably engaged by said support member and a circumferential flange attached to and projecting outwardly from said tubular body between outer and inner opposite ends thereof, said flange being seated on an outer end of said mounting structure such that said outer end of said body projects from said mounting structure and said flange and outer body end are exposed at said exterior side of said casing and define respective exterior bearing surfaces which are engaged by and rotatably support said inner end of said actuating member.

5. The apparatus as recited in claim 4, wherein said flange of said bearing member is attached to said tubular body thereof substantially nearer to said outer end than to said inner end of said body.

6. The apparatus as recited in claim 4, wherein said flange of said bearing member is attached to said tubular body thereof substantially equidistant from said outer and inner ends of said body.

7. The apparatus as recited in claim 4, wherein said positioning mechanism also includes a spring member attached to said mounting structure and engaged with said outer end of said support member so as to bias said first cam element toward said second cam element to maintain engagement therebetween.

8. The apparatus as recited in claim 4, wherein said positioning mechanism also includes a locking element releasably attached to said outer end of said support member for retaining said first cam element removably attached on said outer support member end.

9. The apparatus as recited in claim 1, wherein said first cam element is in the form of an annular washer removably attached on said outer support member end and having a helically-shaped camming surface defined on an inner side of said washer.

10. The apparatus as recited in claim 9, wherein said second cam element is a helically-shaped camming surface defined on an outer side of said inner end of said actuating member which mates with said camming surface on said washer.

11. In a gas turbine engine including a rotatable rotor having a central axis and a row of blades with outer tips and a stationary casing with a shroud disposed in concentric relation with said rotor, an apparatus for controlling the clearance between said rotor blade tips and casing shroud, said apparatus comprising:

(a) a shroud segment defining a circumferential portion of said casing shroud and being separate from said spaced radially inwardly of said casing;

(b) a pair of circumferentially-spaced mounting structures on said stationary casing defining passages between exterior and interior sides of said casing, said mounting structures being spaced radially outwardly from said shroud segment;

(c) a shroud segment positioning mechanism supported by said stationary casing mounting structures, coupled to said shroud segment, and being actuatable for moving said shroud segment toward and away from said rotor blade tips to reach a position relative thereto at which a desired clearance is established between said shroud segment and rotor blade tips; and (d) a pair of actuating members each being rotatable for actuating said positioning mechanism;

(e) each positioning mechanism including:

(i) a pair of circumferentially-spaced support members each being mounted through a respective one of said passages defined by said pair of mounting structures for radial movement relative to said mounting structures and toward and away from said rotor axis, said support members each having a longitudinal axis and opposite inner and outer ends, (ii) a shroud holder extending between and pivotally connected at its opposite ends to said inner ends of said support members, said shroud holder removably holding said shroud segment at said interior side of said casing, (iii) a pair of first cam elements each attached to said outer ends of respective ones of said support members and located at said exterior side of said casing and spaced outwardly from respective ones of said mounting structures, and (iv) a pair of second cam elements attached to said inner ends of respective ones of said actuating members being mounted to said mounting structures for rotational movement relative thereto and about said longitudinal axes of said support meters upon rotation of said actuating members, said second cam elements being located at said exterior side of said casing between spaced mounting structures and first cam elements and engaged with said first cam elements such that rotation of said second cam elements with rotation of said actuating members produce radial movement of said first cam elements and said support members and said shroud segment therewith toward and away from said rotor blade tips.

12. The apparatus as recited in claim 11, wherein said shroud holder has a pair of axially-spaced circumferentially-extending grooves facing toward one another for slidably receiving and holding said shroud segment at spaced longitudinal edge portions thereof.

13. The apparatus as recited in claim 11, wherein said positioning mechanism also includes a pair of elongated pins each pivotally connecting one of said opposite ends of said shroud holder to a respective one of said support members.

14. The apparatus as recited in claim 11, wherein:

each of said mounting structures is a cylindrical boss formed on said casing, defining said passage, and projecting from said exterior side of said casing; and each of said support members is a cylindrical shaft extending through said passage of a respective one of said bosses.

15. The apparatus as recited in claim 11, further comprising:

a pair of bearing members each fitted to a respective one of said mounting structures and extending through said passage thereof, said each bearing member including a tubular body defining an interior bearing surface slidably engaged by a respective one of said support members and a circumferential flange attached to and projecting outwardly from said tubular body between outer and inner opposite ends thereof, said flange being seated on an outer end of said one mounting structure such that said outer end of said body projects from said one mounting structure and said flange and outer body end are exposed at said exterior side of said casing and define respective exterior bearing surfaces which are engaged by and rotatably support said inner end of a respective one of said actuating members.

16. The apparatus as recited in claim 15, wherein said flange of said each bearing member is attached to said tubular body thereof substantially nearer to said outer end than to said inner end of said body.

17. The apparatus as recited in claim 15, wherein said flange of said each bearing member is attached to said tubular body thereof substantially equidistant from said outer and inner ends of said body.

18. The apparatus as recited in claim 11, wherein said positioning mechanism also includes a pair of spring members each attached to respective ones of said mounting structures and engaged with said outer ends of respective ones of said support members so as to bias said first cam elements toward said second cam elements to maintain engagement therebetween.

19. The apparatus as recited in claim 11, wherein said positioning mechanism also includes a pair of locking elements each releasably attached to said outer ends of respective ones of said support members for retaining said first cam elements removably attached on said outer support member ends.

20. The apparatus as recited in claim 11, wherein each of said first cam elements is in the form of an annular washer removably attached on said respective outer support member end and having a helically-shaped camming surface defined on an inner side of said washer.

21. The apparatus as recited in claim 20, wherein each of said second cam elements is a helically-shaped camming surface defined on an outer side of said inner end of said respective actuating member which mates with said camming surface on said washer.

* * * * *